US007326069B1

(12) United States Patent
Duesterhoeft

(10) Patent No.: US 7,326,069 B1
(45) Date of Patent: Feb. 5, 2008

(54) GROUNDING CLIP SYSTEM WITH A SLIDING SHUTTLE

(75) Inventor: Scott S. Duesterhoeft, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/687,855

(22) Filed: Mar. 19, 2007

(51) Int. Cl.
*H01R 4/66* (2006.01)
*H01R 13/648* (2006.01)

(52) U.S. Cl. ..... 439/92; 439/395

(58) Field of Classification Search ..... 439/92, 439/96, 101, 103, 417, 397, 395
See application file for complete search history.

(56) References Cited

U.S. PATENT DOCUMENTS 5,131,863 A * 7/1992 Gerke et al. ..... 439/395
6,616,476 B1 * 9/2003 Moritz et al. ..... 439/404

OTHER PUBLICATIONS

John Wiles; "PV Array Grounding", Home Power 102, Aug. & Sep. 2004, pp. 108-109, New Mexico.

* cited by examiner

*Primary Examiner*—Hae Moon Hyeon

(57) ABSTRACT

A grounding clip system is provided. This system includes a length of electrical wire; a connecting element, wherein the connecting element further includes: first and second side portions; and an area in each side portion adapted to receive the electrical wire and make electrical contact therewith; and a shuttle slidably attached to the connecting element. The shuttle is variably positionable on the connecting element in open and closed positions. The shuttle further includes a channel formed widthwise therein for receiving the electrical wire, and the channel further includes at least two slots formed therein for engaging the first and second side portions of the connecting element. Placing the length of electrical wire in the channel in the body and sliding the shuttle from the opened position to the closed position inserts the length of wire into the connecting element and makes electrical contact therewith.

20 Claims, 3 Drawing Sheets

GROUNDING CLIP SYSTEM WITH A SLIDING SHUTTLE

BACKGROUND OF THE INVENTION

The described invention relates in general to electrical equipment and more specifically to a grounding system and apparatus for use with a variety of electrical devices.

In the context of electronics, a ground is a direct electrical connection to the earth, a connection to a particular point in an electrical or electronic circuit, or an indirect connection that operates as the result of capacitance between wireless equipment and the earth or a large mass of conductive material. Electrical grounding is important because it provides a reference voltage level (called zero potential or ground potential) against which all other voltages in a system are established and measured. An effective connection to ground also minimizes the susceptibility of equipment to interference, reduces the risk of equipment damage due to lightning, eliminates electrostatic buildup that can damage system components, and helps protect personnel who service and repair electrical, electronic, and computer systems. In effect, a connection to ground drains away any unwanted buildup of electrical charge. When a point is connected to an effective ground that point tends to stay at a constant voltage, regardless of what happens elsewhere in the circuit or system.

A grounding clip is a device that may be included in certain types of connectors for ensuring electrical connection to earth or some other conducting body for electrical protection. For example, a grounding clip may provide a grounding path between a receptacle and a mounting screw affixing the receptacle to a grounded mounting box. Although commonly used, existing grounding clips or lugs are often very expensive and difficult or cumbersome to use. Wire termination with existing devices is typically made with a set-screw that has a tendency work loose over time. Thus, there is a need for a grounding clip that simplifies use, lowers cost, and improves wire termination to the clip.

SUMMARY OF THE INVENTION

The following provides a summary of exemplary embodiments of the present invention. This summary is not an extensive overview and is not intended to identify key or critical aspects or elements of the present invention or to delineate its scope.

In accordance with one aspect of the present invention, a grounding clip system is provided. This system includes a grounding path, wherein the grounding path further comprises a length of electrical wire; a connecting element, wherein the connecting element further includes: first and second side portions; and an area in each side portion adapted to receive the electrical wire and make electrical contact therewith; and a shuttle slidably attached to the connecting element. The shuttle is variably positionable on the connecting element and the variable positions include an opened position and a closed position. The shuttle further includes a channel formed widthwise therein for receiving the electrical wire, and the channel further includes at least two slots formed therein and substantially perpendicular thereto for engaging the first and second side portions of the connecting element. Placing the length of electrical wire in the channel in the body and sliding the shuttle from the opened position to the closed position inserts the length of wire into the area in each side portion adapted to receive the electrical wire and makes electrical contact therewith.

In accordance with another aspect of the present invention, a grounding clip apparatus is provided. This apparatus includes a connecting element, wherein the connecting element further includes: a body; wherein the body further includes a horizontal base and first and second vertical side portions formed integrally with the base, and wherein each side portion further includes a retention notch for receiving an electrical wire and making electrical contact therewith; and a shuttle element slidably attached to the connecting element. The shuttle element further includes: a body, wherein the body of the shuttle element is variably positionable on the body of the connecting element, and wherein the variable positions include an opened position and a closed position; and wherein the body further includes a channel formed widthwise therein, and wherein the channel further includes at least two slots formed therein and substantially perpendicular thereto for engaging the first and second side portions of the connecting element.

In yet another aspect of this invention, a method for grounding an electrical circuit is provided. This method includes: providing a grounding path, wherein the grounding path further comprises a length of electrical wire; providing a connecting element, wherein the connecting element further includes: first and second side portions; and an area in each side portion adapted to receive the electrical wire and make electrical contact therewith; and slidably attaching a shuttle to the connecting element, wherein the shuttle is variably positionable on the connecting element. The variable positions include an opened position and a closed position, and the shuttle further includes: a channel formed widthwise therein for receiving the electrical wire; and wherein the channel further includes at least two slots formed therein and substantially perpendicular thereto for engaging the first and second side portions of the connecting element. The length of electrical wire is then placed in the channel and the shuttle is slid from the opened position to the closed position, wherein sliding the shuttle from the opened position to the closed position inserts the length of wire into the area in each side portion of the connecting element that has been adapted to receive the electrical wire and make electrical contact therewith.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
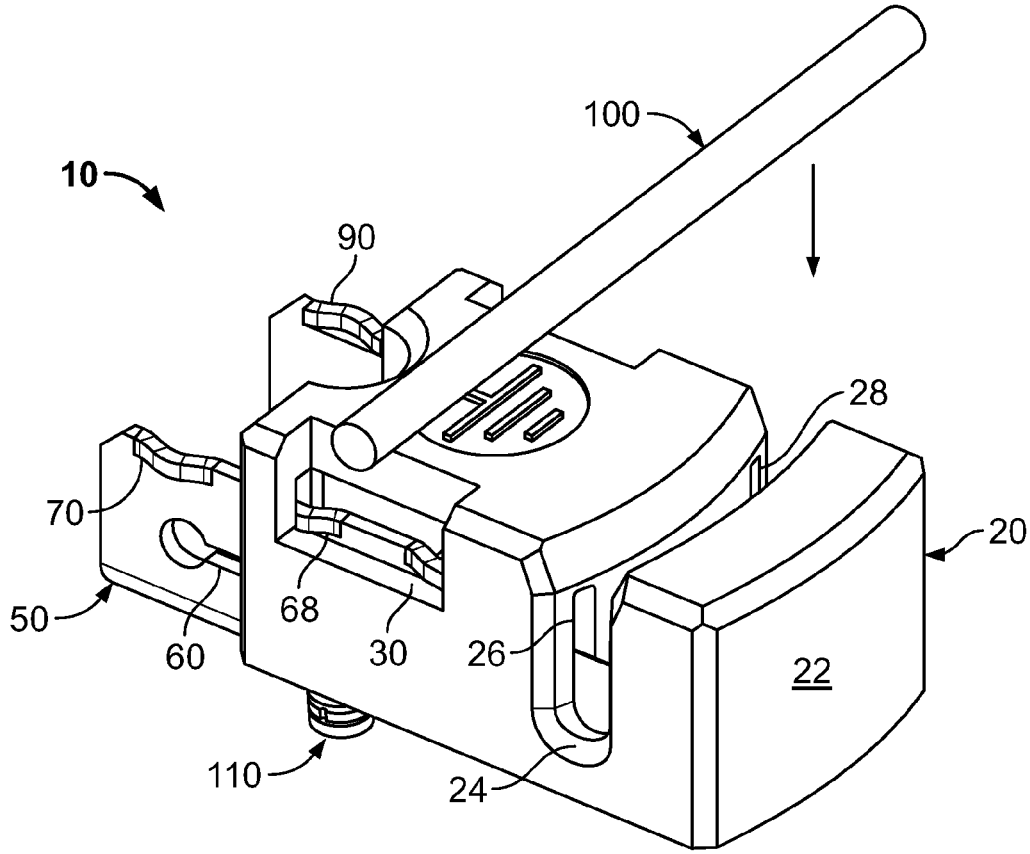
FIG. 1 is top a perspective view of an exemplary embodiment of the grounding clip system of the present invention showing the grounding clip in an opened position prior to insertion of an electrical wire into the device.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to a system and device for use with electrical equipment and photovoltaic equipment in particular. A first general embodiment of this invention provides a grounding clip system. A second general embodiment of this invention provides a grounding clip apparatus. A third general embodiment of this invention provides a method for grounding an electrical circuit using this system and apparatus.

Figure 2:
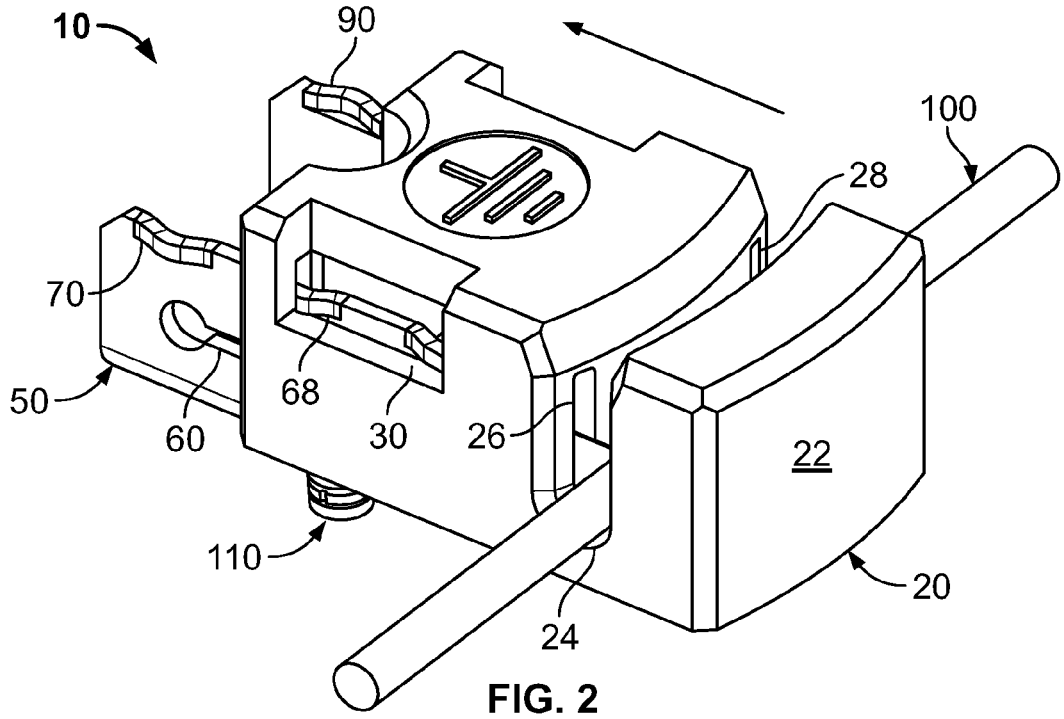
FIG. 2 is a top perspective view of the exemplary embodiment of FIG. 1, showing the grounding clip in an opened position following insertion of an electrical wire into the device.
Figure 3:
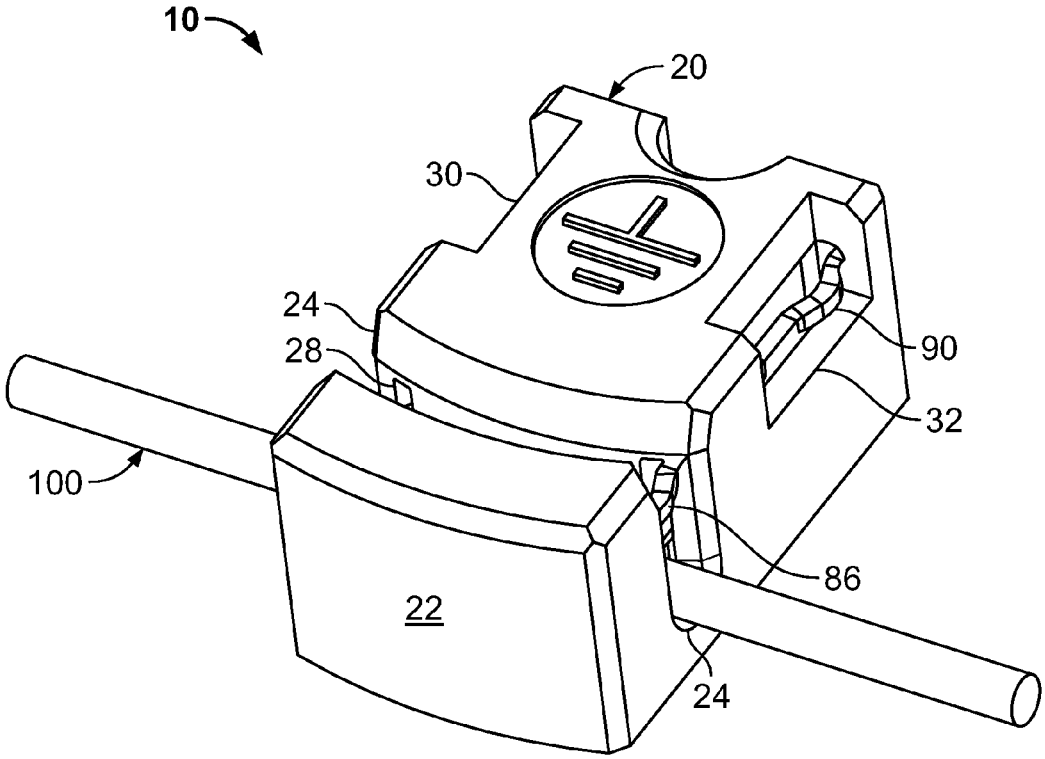
FIG. 3 is a top perspective view of the exemplary embodiment of FIG. 1, showing the grounding clip in a closed position following insertion of an electrical wire into the device and following the termination of the electrical wire to the connecting element.

With reference now to the Figures, FIGS. 1-3 provide top perspective views of an exemplary embodiment of grounding clip system 10 prior to the termination of cable or ground wire 100 and following the termination of ground wire 100. Grounding clip system 10 includes shuttle 20 and connecting element 50, to which shuttle 20 is slidably connected. As best shown in FIGS. 1-2, shuttle 20 further includes body 22, which is typically a dielectric, but that may be metallic or conductive. Channel 24 is formed widthwise in body 22 at one end of shuttle 20 and includes first slot 26 and second slot 28, both of which are formed perpendicularly to channel 24 and pass completely through the material of shuttle 20. In some embodiments, slots 26 and 28 extend through to the front or forward portion of body 22 and in alternate embodiments, the front portion of body 22 is closed. First aperture 30 and second aperture 32 are also formed in body 22 and cooperate with structures on connecting element 50 for slidably retaining shuttle 20 thereon.

Figure 4:
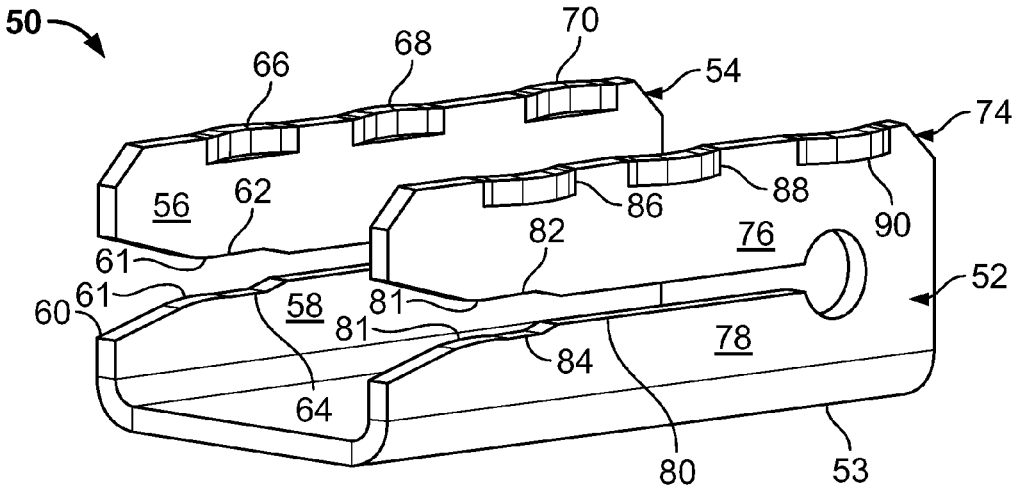
FIG. 4 is a front perspective view of an exemplary embodiment of the connecting element of the grounding clip system of the present invention.
Figure 5:
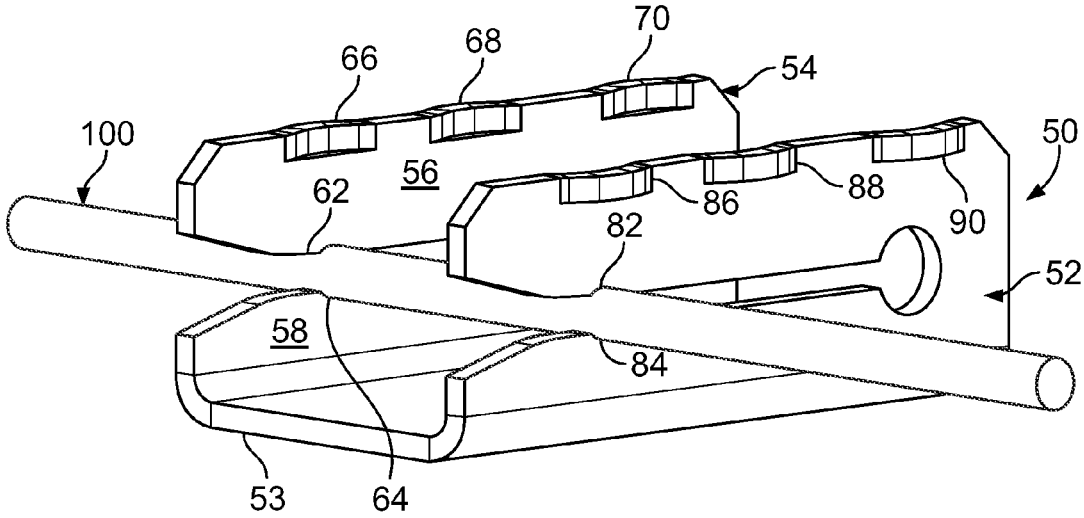
FIG. 5 is a front perspective view of an exemplary embodiment of the connecting element of the grounding clip system of the present invention following termination of an electrical wire to the connecting element.
Figure 6:
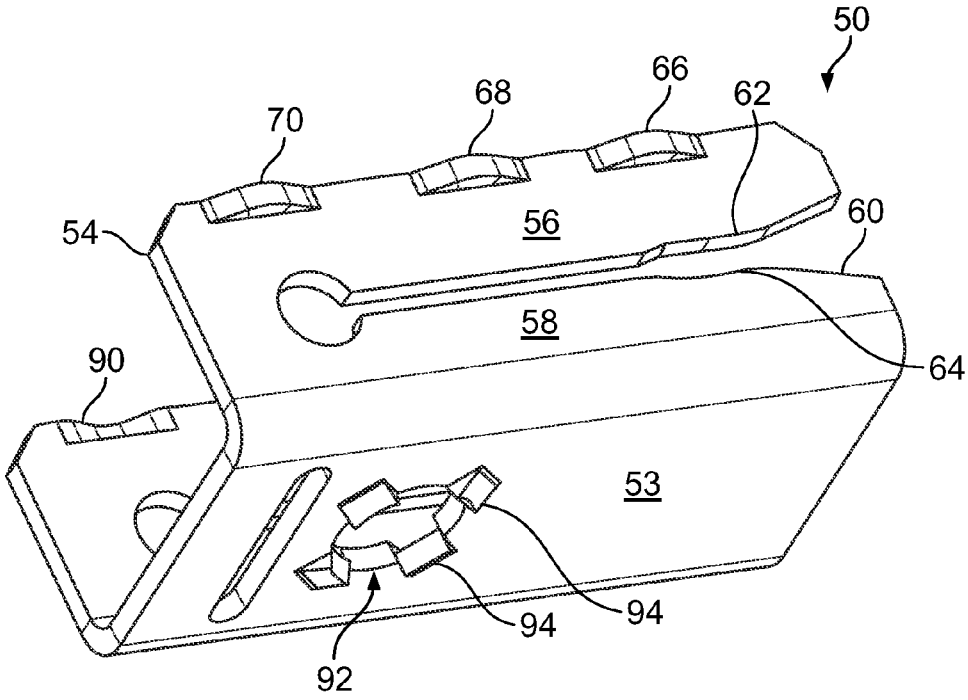
FIG. 6 is a bottom perspective view of an exemplary embodiment of the connecting element of the grounding clip system of the present invention showing the position of the piercing feature within the base portion of the connecting element.

As best shown in FIGS. 4-6, an exemplary embodiment of connecting element 50, which is manufactured from an electrically conductive material, includes a body 52, which includes a base 53 that connects first side portion 54 to second side portion 74. Base 53 includes an aperture or is otherwise adapted for receiving mounting screw 110 (see FIG. 1) which is used to secure connecting element 50 to a substrate such a piece of sheet metal or other metallic material. When shuttle 20 is in the open position, mounting screw 110 is retained in a position suitable for mounting connecting element 50 on the substrate. First side portion 54 includes an upper portion 56 and a lower portion 58 separated by first channel 60, which is typically an Insulation Displacement Connector (IDC) style slot. First channel 60 includes retention notch 61 that further includes an upper concave surface 62 and a lower concave surface 64. Front, middle, and rear flanges 66, 68, and 70, respectively, are formed along a first top edge of connecting element 50 and cooperate with first aperture 30 for slidably retaining shuttle 20 thereon. Second side portion 74 includes an upper portion 76 and a lower portion 78 separated by second channel 80, which is also typically an IDC-style slot. Second channel 80 includes retention notch 81 that further includes an upper concave surface 82 and a lower concave surface 84. Front, middle, and rear flanges 86, 88, and 90, respectively, are formed along a second top edge of connecting element 50 and cooperate with second aperture 32 for slidably retaining shuttle 20 thereon. The various flanges formed on body 52 are also used to incrementally index shuttle 20 from the open to the closed position on connecting element 50.

When properly installed, grounding clip system 10 is used for grounding an electrical circuit by first moving shuttle 20 to the opened position shown in FIGS. 1 and 2 (note: clip system 10 is typically provided to the customer in the "open" position). Ground wire 100 is then fully inserted into channel 24 and shuttle 20 is moved, i.e., slid, to the closed position shown in FIG. 3. The sliding motion of shuttle 20 along the length of connecting element 50 moves wire 100 toward connecting element 50. The front edges of first and second side portions 54 and 74 protrude into and through first and second slots 26 and 28 respectively, thereby feeding wire 100 into the mouth of first channel 60 and second channel 80. As wire 100 enters first and second channels 60 and 80, shielding on the exterior of the wire is stripped away. The metal of the wire contacts the conductive material of connecting element 50 and makes contact therewith. When shuttle 20 is fully closed as in FIG. 3 and wire 100 has been terminated thereto, retention notches 61 and 81 prevent wire 100 from inadvertently detaching from connecting element 50. Advantageously, additional tools or devices need not be used to terminate ground wire 100 with the system and method described herein. Following termination, a flathead screwdriver may be used to open shuttle 20 and release wire 100, if desired.

With reference to FIG. 6, some embodiments of this invention include barrier piercing feature 92, which further includes a plurality of wedge-shaped protrusions 94. These protrusions break through any barrier that has formed on or been deposited on a substrate to which grounding clip system 10 is to be mounted. For example, grounding clip system 10 is compatible with solar panels. If the metal frame of such a panel is bare aluminum, an oxide film may form thereon over time. Some metal frames are coated or insulated with an anodizing material. Piercing feature 92 effectively breaks through such barriers when grounding clip system 10 is properly installed.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed is:

1. A grounding clip system, comprising:

(a) a grounding path, wherein the grounding path further comprises a length of electrical wire;

(b) a connecting element, wherein the connecting element further includes:

(i) first and second side portions; and (ii) an area in each side portion adapted to receive the electrical wire and make electrical contact therewith; and (c) a shuttle slidably attached to the connecting element, wherein the shuttle is variably positionable on the connecting element, wherein the variable positions include an opened position and a closed position, and wherein the shuttle further includes:

(i) a body including a channel formed widthwise therein for receiving the electrical wire;

(ii) wherein the channel further includes at least two slots formed therein and substantially perpendicular thereto for engaging the first and second side portions of the connecting element; and (iii) wherein placing the length of electrical wire in the channel in the body and sliding the shuttle from the opened position to the closed position inserts the length of wire into the area in each side portion adapted to receive the electrical wire and makes electrical contact therewith.

2. The system of claim 1, further comprising a mounting screw for attaching the connecting element to a substrate.

3. The system of claim 1, wherein the connecting element further comprises an Insulation Displacement Connector (IDC) style slot formed in each of the first and second side portions.

4. The system of claim 1, wherein the connecting element further includes a plurality of flanges formed along the top edge of each side portion, and wherein each of the flanges cooperates with the shuttle to variably position the shuttle on the connecting element.

5. The system of claim 4, wherein the shuttle further includes first and second apertures formed therein for cooperating with the flanges formed on the connecting element.

6. The system of claim 1, wherein the area in each side portion adapted to receive the electrical wire further includes a retention notch for securing the electrical wire therein.

7. The system of claim 1, wherein the shuttle is manufactured from at least one of a dielectric material and an electrically conductive material.

8. A grounding clip apparatus, comprising:

(a) a connecting element, wherein the connecting element further includes:

(i) a body;

(ii) wherein the body further includes a horizontal base and first and second vertical side portions formed integrally with the base; and (iii) wherein each side portion further includes a retention notch for receiving an electrical wire and making electrical contact therewith; and (b) a shuttle element slidably attached to the connecting element, wherein the shuttle element further includes:

(i) a body;

(ii) wherein the body of the shuttle element is moveable between an open position and a closed position on the body of the connecting element; and (iii) wherein the body of the shuttle further includes a channel formed widthwise therein, and wherein the channel further includes at least two slots formed therein and substantially perpendicular thereto for engaging the first and second side portions of the connecting element.

9. The grounding clip apparatus of claim 8, wherein the base of the connecting element further comprises a barrier piercing feature for piercing oxides, coatings, insulation, and other barriers.

10. The grounding clip apparatus of claim 8, wherein the connecting element further comprises an IDC-style slot formed in each of the first and second side portions and wherein retention notches are located in the IDC-style slots.

11. The grounding clip apparatus of claim 8, wherein the connecting element further includes a plurality of flanges formed along the top edge of each side portion, and wherein each of the flanges cooperates with the shuttle to variably position the shuttle on the connecting element.

12. The grounding clip apparatus of claim 11, wherein the shuttle further includes first and second apertures formed therein for cooperating with the flanges formed on the connecting element.

13. The grounding clip apparatus of claim 8, wherein the shuttle element is manufactured from at least one of a dielectric material and an electrically conductive material.

14. A method for grounding an electrical circuit, comprising:

(a) providing a grounding path, wherein the grounding path further includes a length of electrical wire;

(b) providing a connecting element, wherein the connecting element further includes:

(i) first and second side portions; and (ii) an area in each side portion adapted to receive the electrical wire and make electrical contact therewith; and (c) slidably attaching a shuttle to the connecting element, wherein the shuttle is moveable between an open position and a closed position on the connecting element; and wherein the shuttle further includes:

(i) a channel formed widthwise therein for receiving the electrical wire; and (ii) wherein the channel further includes at least two slots formed therein and substantially perpendicular thereto for engaging the first and second side portions of the connecting element; and (d) placing the length of electrical wire in the channel; and (e) sliding the shuttle from the opened position to the closed position, wherein sliding the shuttle from the opened position to the closed position inserts the length of wire into the area in each side portion of the connecting element that has been adapted to receive the electrical wire and make electrical contact therewith.

15. The method of claim 14, further comprising providing a mounting screw for attaching the connecting element to a substrate.

16. The method of claim 14, wherein the connecting element further comprises an IDC-style slot formed in each of the first and second side portions.

17. The method of claim 14, wherein the connecting element further includes a plurality of flanges formed along the top edge of each side portion, and wherein each of the flanges cooperates with the shuttle to variably position the shuttle on the connecting element.

18. The method of claim 17, wherein the shuttle further includes first and second apertures formed therein for cooperating with the flanges formed on the connecting element.

19. The method of claim 14, wherein the area in each side portion adapted to receive the electrical wire further includes a retention notch for securing the electrical wire therein.

20. The method of claim 14, wherein the shuttle is manufactured from a dielectric material.

* * * * *